US006688252B1

(12) United States Patent
Caravella

(10) Patent No.: US 6,688,252 B1
(45) Date of Patent: Feb. 10, 2004

(54) BOAT COVER

(76) Inventor: Gary Caravella, 144 Rosehaven Rd., Somers, CT (US) 06071

( * ) Notice: Subject to any disclaimer, the term of this patent is extended or adjusted under 35 U.S.C. 154(b) by 0 days.

(21) Appl. No.: 10/316,823

(22) Filed: Dec. 11, 2002

(51) Int. Cl.[7] ..... B63B 17/02
(52) U.S. Cl. ..... 114/361; 135/90
(58) Field of Search ..... 114/361, 44, 45; 135/90, 122; 405/4; 296/26.05

(56) References Cited

U.S. PATENT DOCUMENTS 3,083,540 A 4/1963 Smith ..... 61/65
4,019,212 A 4/1977 Downer ..... 135/6
5,769,105 A 6/1998 Margol et al. ..... 135/90
6,102,059 A * 8/2000 Miller ..... 135/87
6,447,038 B1 * 9/2002 Davis et al. ..... 296/26.05

* cited by examiner

*Primary Examiner*—Jesus D. Sotelo
(74) *Attorney, Agent, or Firm*—McCormick, Paulding & Huber LLP

(57) ABSTRACT

An apparatus for covering a boat that includes a canopy, a plurality of canopy supports, and one or more drivers. The canopy is sized to cover at least a portion of the boat, and includes a bottom edge and a peak. The plurality of canopy supports each have a first portion and a second portion. The first portion is movable relative to the second portion. The first portion is attached to the canopy and disposed vertically below the peak. The first portion of each canopy support is selectively extendable a distance between a first position and a second position. The one or more drivers are operable to drive the first portions of the canopy supports between the first position and the second position.

7 Claims, 5 Drawing Sheets

BOAT COVER

BACKGROUND OF THE INVENTION

Technical Field

This invention relates to apparatus for covering boats in general, and to apparatus that can be used as a low profile cover for a boat in water in particular.

Background Information

For a variety of reasons it is advantageous to protect a boat from the environment (e.g., rain, sunlight, debris, birds, etc.) when the boat is not in use. Custom fit boat covers that attach to the boat provide protection, but are cumbersome to install and remove, and do not always protect the entire boat. Boat houses or other enclosures having a fixed roof under which the boat can be stored are considerably more convenient, but also have some disadvantages. The roof of a boat house or enclosure is typically eight feet above the water. The substantial opening of the boat house (and open walls of a fixed roof enclosure) expose the boat to rain, debris, and the like. Hence, many boat owners that utilize a boat house also use a custom cover and experience the above-described disadvantages. In addition, birds often nest under fixed roof enclosures. Substantial bird droppings often accompany bird nests, consequently impacting anything under the fixed roof enclosure. In many instances, regulations significantly limit and sometimes prohibit adding new or altering existing boat houses or other fixed roof enclosures because they obstruct the shore view. In addition, boat houses or fixed roof enclosures are expensive and many areas significantly tax these structures.

What is needed, therefore, is an apparatus for covering a boat that is easy to use, one that provides considerable protection, and one that has a desirably low profile.

DISCLOSURE OF THE INVENTION

According to the present invention, an apparatus for covering a boat is provided. The apparatus includes a canopy, a plurality of canopy supports, and one or more drivers. The canopy is sized to cover at least a portion of the boat, and includes a bottom edge and a peak. The plurality of canopy supports each have a first portion and a second portion. The first portion is movable relative to the second portion. The first portion is attached to the canopy and disposed vertically below the peak. The first portion of each canopy support is selectively extendable relative to the second portion a distance between a first position and a second position. The one or more drivers are operable to drive the first portions of the canopy supports between the first position and the second position. When in the first position, the canopy is located in close proximity to the boat. In the second position, the bottom edge of the canopy is vertically above the uppermost point of the boat (i.e., the highest vertical point above the gunnels of the boat), thereby enabling the boat to be moved under or out from the canopy. In a preferred embodiment, the second position of the canopy is high enough to allow people to enter and exit the boat from the dock.

An advantage of the present invention is that an apparatus for covering a boat is provided that is easy to use. The present invention obviates the need to attach a custom sized boat cover over the boat when the boat is not in use. A further advantage of the present invention is the considerable protection it provides. As stated above, boathouses are often inhabited by birds that can create an undesirable mess.

The present invention minimizes the chance birds will nest because it is lowered over the boat when the boat is not in use, thereby inhibiting access to the underside structure of the canopy. A further advantage of the present invention is its desirable low profile. Structures that provide a lower profile along the shore are substantially favored over higher profile structures in most settings, because they obstruct less of the shoreline or water depending upon the viewpoint. In fact, in many applications traditional boathouses are either not allowed or are significantly regulated. The present invention provides an alternative to a traditional boat house.

These and other objects, features and advantages of the present invention will become apparent in light of the detailed description of the present invention.

DETAILED DESCRIPTION OF THE INVENTION

Figure 1:
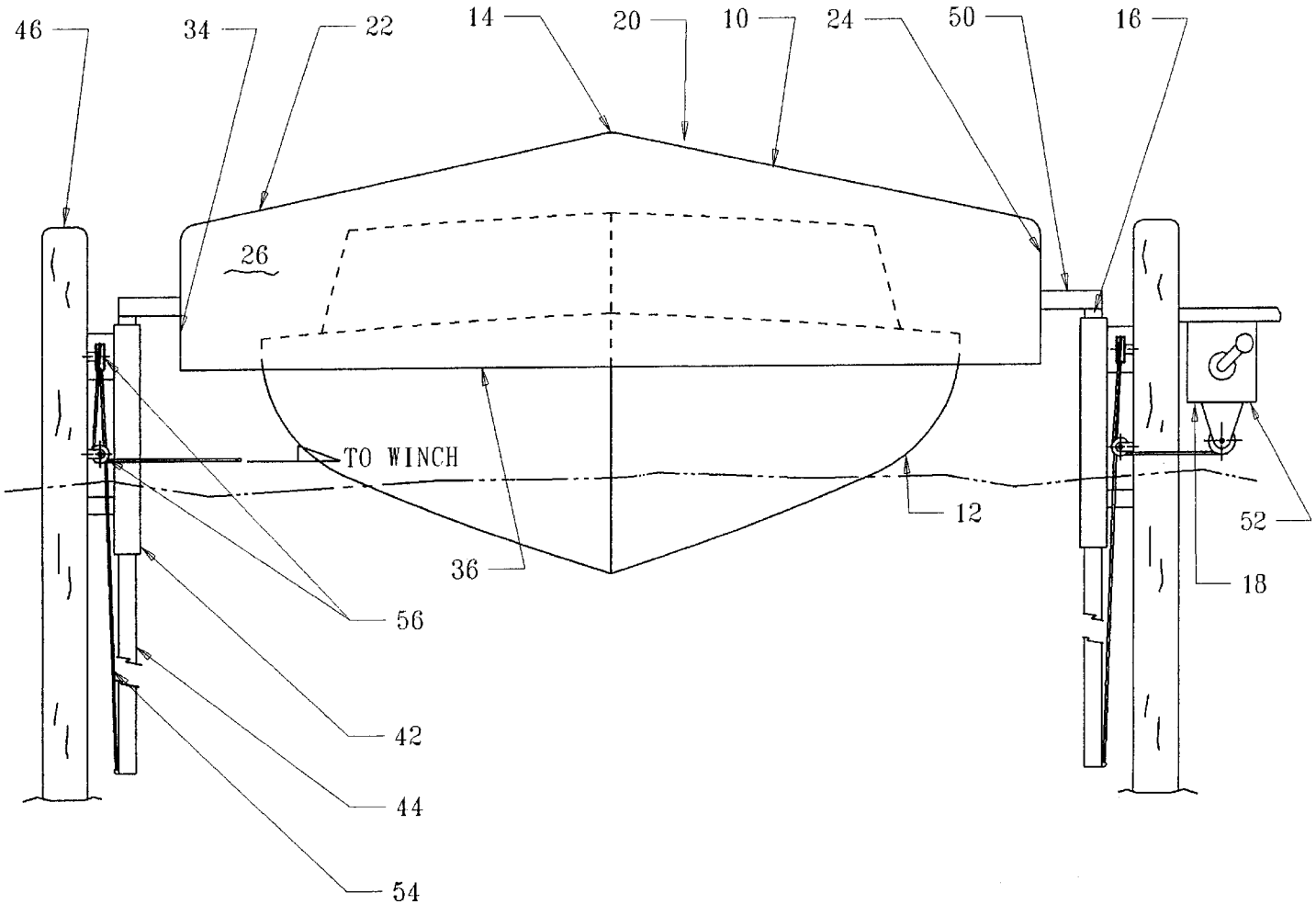
FIG. 1 is a diagrammatic front-end view of the present invention apparatus for covering a boat, shown in a first, lowered position covering a boat.
Figure 2:
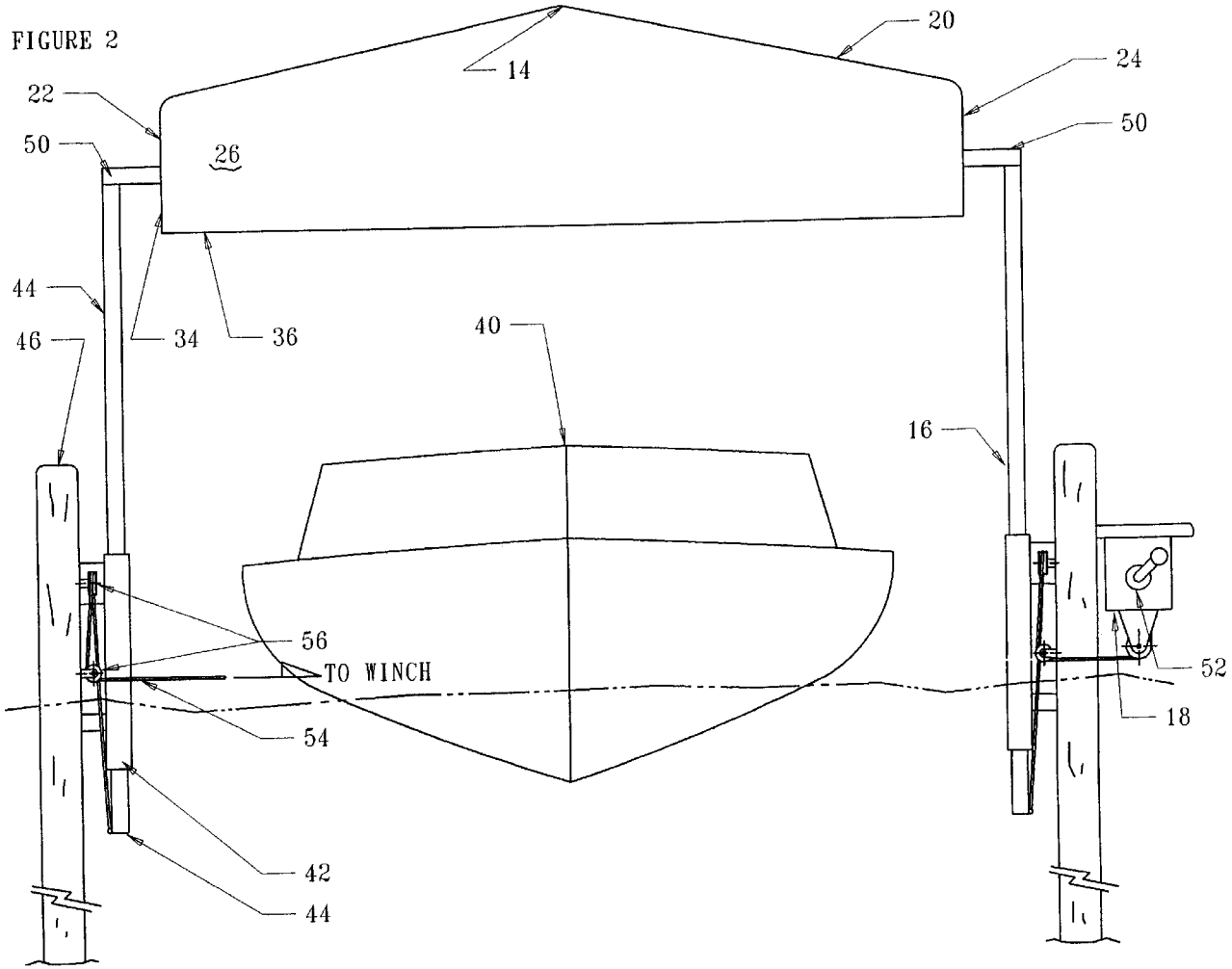
FIG. 2 is a diagrammatic front-end view of the present invention apparatus for covering a boat, shown in a second, raised position above a boat.

Referring to FIGS. 1–4, an apparatus 10 for covering a boat 12 is shown that includes a canopy 14 sized to cover at least a portion of the boat 12, a plurality of canopy supports 16, and one or more drivers 18 operable to drive the canopy supports 16 between a first, or "lowered", position (see FIG. 1) and a second, or "raised", position (see FIG. 2).

Figure 3:
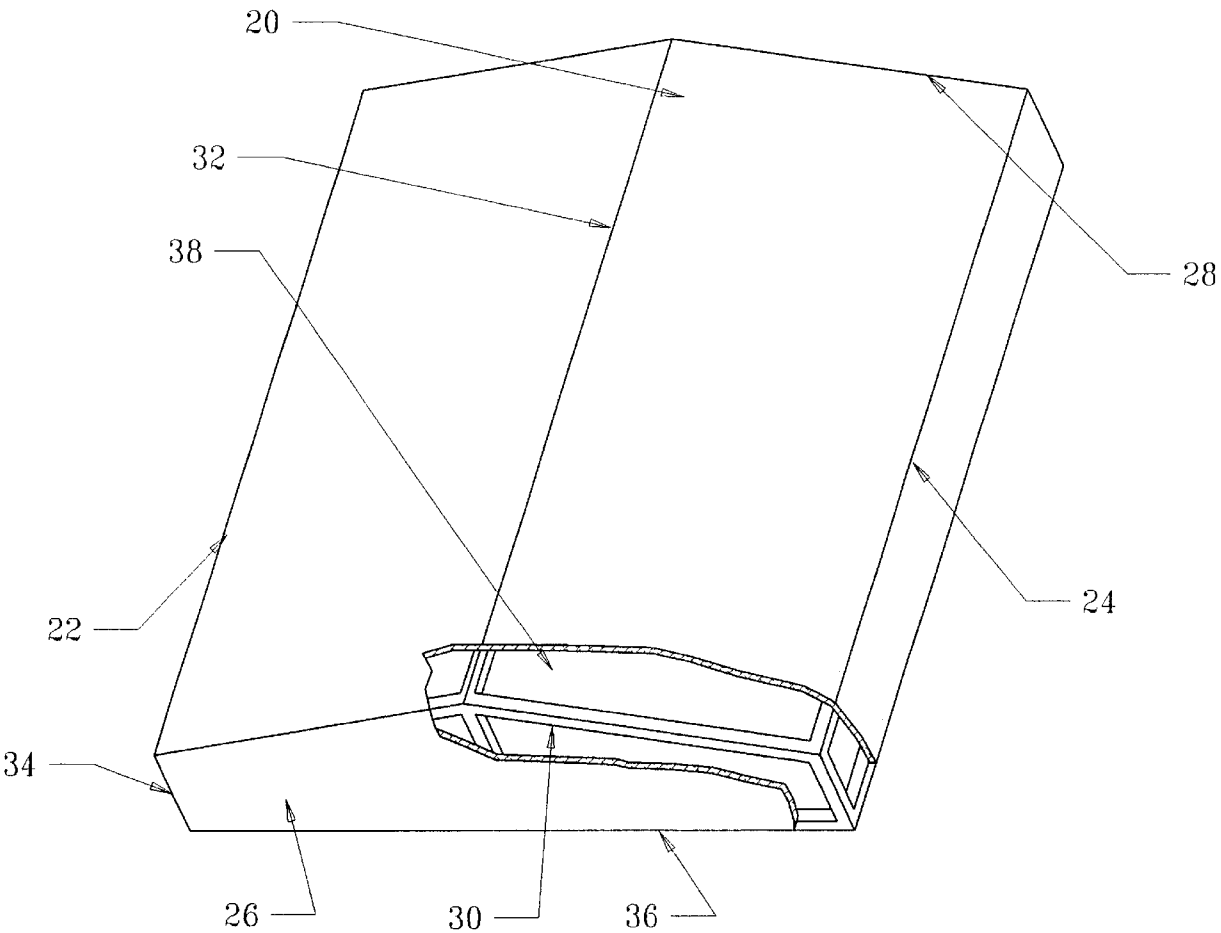
FIG. 3 is a diagrammatic perspective view of the canopy portion of the present invention.

In the rectangular embodiment shown in FIGS. 1–3, the canopy 14 includes a panel 20 that extends between a first side 22 and a second side 24, and a first end 26 and a second end 28. The first and second sides 22, 24 extend lengthwise between the first and second ends 26, 28. The first and second ends 26, 28 extend widthwise between the first and second sides 22, 24. In other embodiments where the canopy 14 is not rectangularly shaped (e.g., elliptical, circular, etc.), the panel 20 may be described as extending between the edges of the perimeter of the relevant shape. The panel 20 may be a single piece or multiple pieces connected together, and may consist of a variety of materials including, but not limited to, plastic, nylon, canvas, wood, fiberglass, etc. The panel 20 is typically mounted on a frame 30 for support. A tubular aluminum frame is an example of an acceptable frame 30. The canopy 14 includes a peak 32 to facilitate water run-off. The peak 32 may be inherent in the geometry of the canopy 14 (e.g., the tent-like structure shown), or it may be accomplished by positioning the canopy 14 in a non-horizontal orientation. In all embodiments, the point of the canopy 14 that is the highest vertical point when the canopy 14 is installed is referred to as the peak 32. In some embodiments, the canopy 14 includes skirt sections 34 disposed around the perimeter of the canopy 14. The lowest surface of the canopy 14 when the canopy 14 is installed, in terms of vertical position, is referred to as the bottom edge 36. In those embodiments having skirt sections 34 disposed around the perimeter of the canopy 14, the bottom of the skirt section(s) 34 is the bottom edge 36 of the canopy 14. In some embodiments, (e.g., those shown in FIGS. 1–4), the canopy includes an interior cavity 38.

Figure 4:
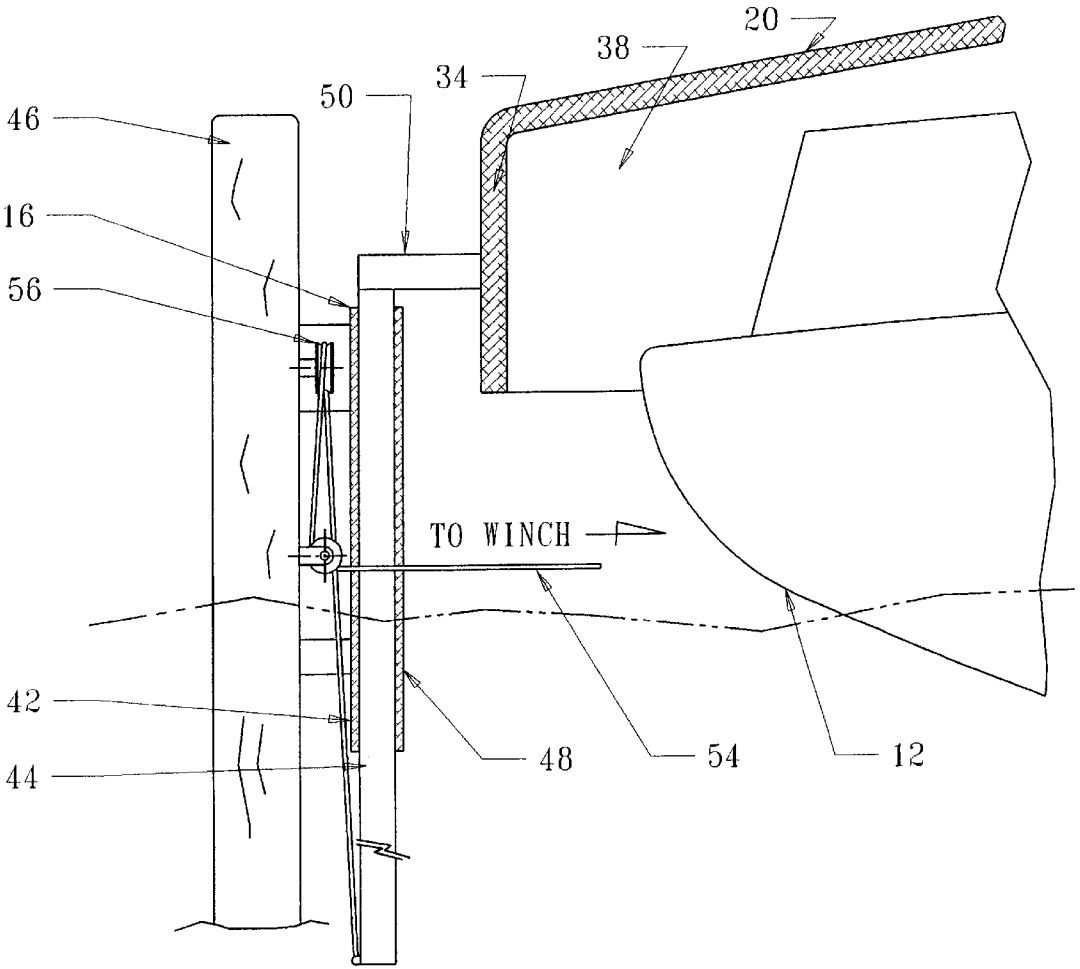
FIG. 4 is a diagrammatic view of one of the canopy supports.

Referring to FIGS. 1, 2, and 4, each canopy support 16 is selectively extendable between the lowered position and the raised position. FIGS. 1 and 4 show the canopy supports 16 and attached canopy 14 in the lowered position where the canopy 14 is in close proximity to the boat 12. In those embodiments where the canopy 14 includes an interior cavity 38, the boat 12 can be at least partially received within the cavity 38 (see FIG. 1). FIG. 2 shows the canopy supports 16 and attached canopy 14 in the raised position where the canopy 14 is positioned a distance above the uppermost point 40 of the boat 12 to enable the boat 12 to be moved under, or out from under, the canopy 14 without interference. As stated above, preferably the canopy can assume a raised position that is high enough to allow people to enter and exit the boat from a dock, or other structure adjacent the boat.

The canopy supports 16 each includes a first portion and a second portion. In the embodiment shown in FIG. 4, the canopy supports 16 each include a second portion in the form of a support tube 42 and a first portion in the form of a post 44. The support tube 42 is attached to an anchored structure such as a dock or a pile 46. The post 44 is slidably received within an axially extending cavity 48 disposed in the support tube 42. Bearings or guide surfaces (not shown) may be disposed within the cavity 48 and/or attached to the outer surface of the post 44 to facilitate relative movement between the support tube 42 and the post 44. The support tube 42 and post 44 shown in FIG. 4 have mating cylindrical geometries. Other support tube 42 and post 44 geometries can be used alternatively. For example, the embodiment shown in FIG. 4 has the movable post 44 as the male portion of the support tube/post pair. In alternative embodiments, the post 44 can be the female half of the pair and be configured to receive a guide member rather than be received within a support tube 42 as is described above. In a further example, the support tube 42 may be replaced by guide surfaces disposed adjacent the post 44. At each canopy support 16, one or more brackets 50 connect the canopy 14 to the post 44. In the embodiment shown in FIG. 4, the bracket 50 is attached to or adjacent the end of the post 44 to minimize the height of the canopy support 16 above the waterline when installed. The movement of the post 44 with the canopy 14 (as opposed to a canopy that moves up and down one or more fixed posts) relative to the support tube 42 is one of the characteristics of the present invention that minimizes the profile of the present invention cover apparatus 10. The position of the canopy supports 16 relative to the canopy 14 can be adjusted to accommodate the application at hand; e.g., positioned on an end and/or a side of the canopy 14, etc. The Figures show an application that includes four canopy supports 16. A greater or fewer number of canopy supports 16 can be used in other applications.

Figure 5:
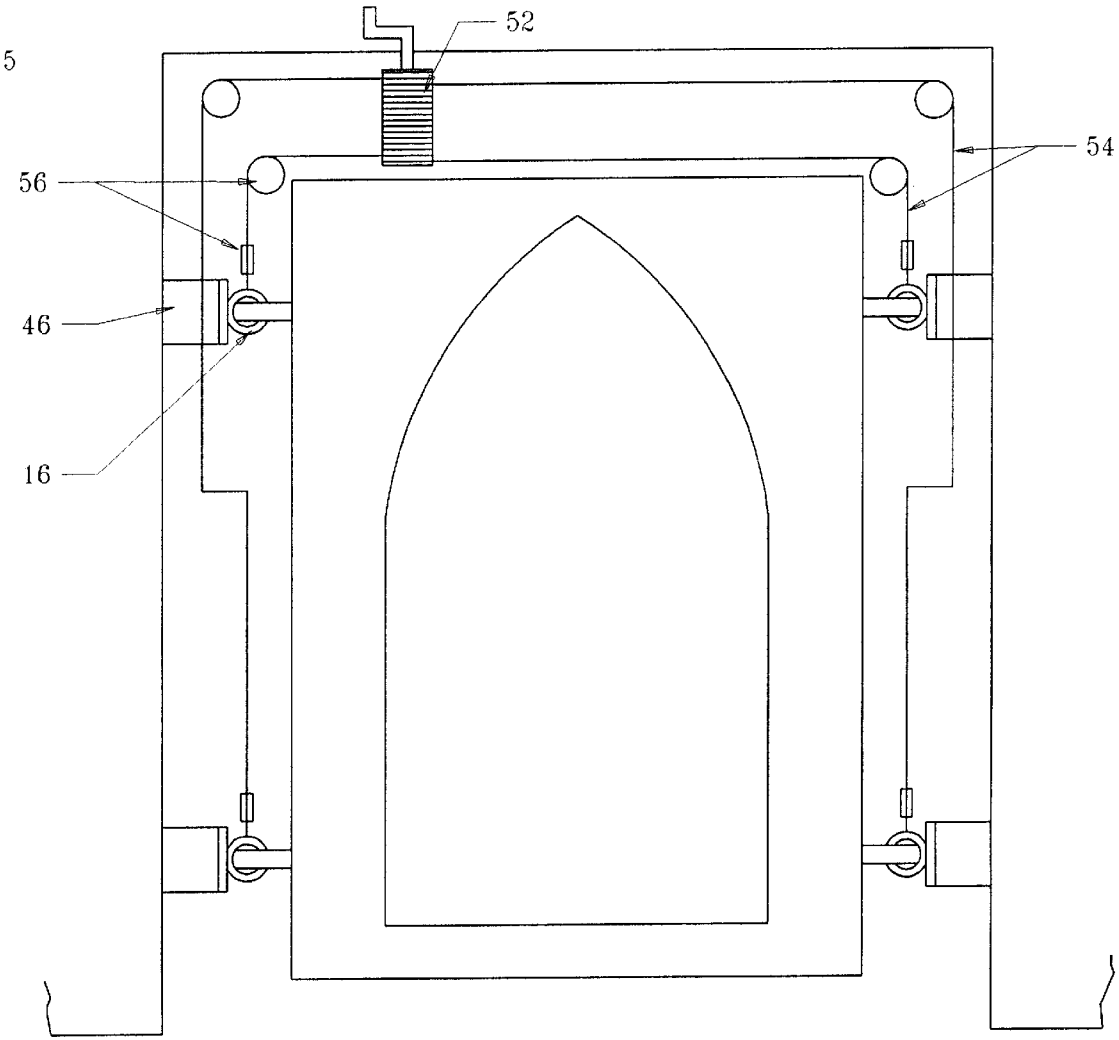
FIG. 5 is a diagram of a driver embodiment having a plurality of cables driven by a winch.

The driver 18 operable to drive the canopy supports 16 between the lowered position and the raised position is diagrammatically shown in FIGS. 1, 2, and 4 as a winch 52 connected to the plurality of canopy supports 16 by cables 54. The cables 54 are connected to the posts 44 in a manner that enable the posts 44 to be raised by shortening the unwound portions of the cable 54 via the winch 52 (i.e., winding), or lowered by lengthening the unwound portions of the cable 54 via the winch 52 (i.e., unwinding). Each cable 54 is routed between a canopy support 16 and the winch 52 using pulleys 56 and deflectors as necessary. FIG. 5 diagrammatically shows a cable 54 routed from each canopy support 16 to the winch 52. FIG. 4 shows a cable 54 fixed at one end to the bottom of the post 44, then upward and around a pulley 56 attached to the pile 46, and then traveling to another pulley 56 located adjacent the lower end of the support tube 42. This configuration is a diagrammatic representation of a possible configuration. A variety of other configurations can be used with cables 54 to raise and lower the post 44 and therefore the canopy 14 between the lowered position and the raised position.

The winch 52 can be manually operated or it can be operated in a power-assisted manner (e.g., electrically, hydraulically, pneumatically, etc.). In those embodiments where the winch 52 is operated in a power-assisted manner, a remote activation device can be used to activate the driver 18 to raise or lower the canopy supports 16 and attached canopy 14. For example, a push button or code operated transmitter can be used in conjunction with a receiver electrically connected to the winch 52 to operate the winch.

The present invention is not limited to the winch 52 and cable 54 embodiment of the driver 18 described above. In an alternative driver 18 embodiment, each post 44 is driven by an individual drive and the individual drives controlled to operate in unison. For example, a gear drive can be disposed at each canopy support 16 engaged with a geared rack (not shown) attached to the post 44. The gear drives can be controlled in unison to drive the canopy supports 16 between the first position and the second position. In other alternative embodiments, the canopy supports 16 and driver 18 can be integrated; e.g., driven threaded rods, hydraulically or pneumatically actuated columns, etc.

In the operation of the present invention apparatus for covering a boat 12, the user actuates the driver 18 to position the canopy 14 and canopy supports 16 into the raised position. The boat 12 is maneuvered under the canopy 14 and positionally secured; e.g., tied to the dock or pile 46. In the preferred embodiment, the user can exit the boat with the canopy 14 in the raised position without interference from the canopy 14. The user subsequently actuates the driver 18 to lower the canopy 14 and canopy supports 16 to the lowered position. If a manual embodiment of the driver 18 is utilized (e.g., a manually operated winch), the user cranks the driver 18 until the canopy 14 is in the lowered position. In some embodiments, physical stops are attached to the canopy supports 16 to indicate when the canopy 14 has reached the lowered position. In those embodiments where the driver 18 is operated in a power-assisted mode (e.g., electric winch operated by remote control), the user actuates the driver 18 by switch or push button and a control mechanism attached to the driver 18 powers the driver 18 until a limit switch or the like is tripped, indicating that the canopy 14 and canopy supports 16 are in the lowered position. When the user desires to access the boat 12, the user manually or automatically actuates the driver 18 in a similar manner until the canopy 14 is elevated to the raised position. Once the boat 12 is removed, the canopy 14 can be returned to the low profile lowered position until the boat 12 returns.

Although this invention has been shown and described with respect to the detailed embodiments thereof, it will be understood by those skilled in the art that various changes in form and detail thereof may be made without departing from the spirit and the scope of the invention. For example, the driver 18 may include a separately operable unit at each canopy support 16 rather than the one or more units described above that operate in unison. In another example, the present invention 10 is described as being an apparatus for covering a boat 12. It can be used for other applications where a low profile cover is desirable. For example, it can be used to cover watercraft other than a boat; e.g., jet skis, rafts, etc.

What is claimed is:

1. An apparatus for covering a boat having an uppermost point, comprising:

a canopy sized to cover at least a portion of the boat, wherein the canopy has a bottom edge and a peak;

a plurality of canopy supports, each having a first portion and a second portion, wherein the first portion is movable relative to the second portion, and the first portion is attached to the canopy and disposed vertically below the peak, wherein the first portion of each canopy support is selectively extendable a distance between a first position and a second position;

one or more cables, each connected to at least one first portion and disposed outside of the respective canopy support; and one or more winches connected to the one or more cables, the one or more winches operable to drive the first portions of the canopy supports between the first position and the second position;

wherein the canopy has an interior cavity, and the distance between the first position and the second position is great enough such that the boat can be at least partially received within the interior cavity of the canopy when the canopy supports are in the first position, and the canopy bottom edge is vertically above the uppermost point of the boat when the canopy supports are in the second position.

2. The apparatus of claim 1, wherein the first portion and second portion of each of the plurality of canopy supports form a mating pair.

3. The apparatus of claim 2, wherein the second portion of each of the plurality of canopy supports is attachable to an anchored structure.

4. The apparatus of claim 2, wherein the one or more winches are power assisted and can be operated by a remote control.

5. The apparatus of claim 2, wherein the first portion of each canopy support is received within the second portion.

6. The apparatus of claim 5, wherein each first portion has a first end and a second end, and the first portion is attached to the canopy adjacent the first end, and the cable is attached to the first portion adjacent the second end.

7. The apparatus of claim 6, wherein the second portion of each canopy support is disposed between the first end and the second end.

* * * * *